United States Patent [19]

Fassett

[11] 3,943,523

[45] Mar. 9, 1976

[54] AIRBORNE MULTI-MODE RADIATING AND RECEIVING SYSTEM

[75] Inventor: Matthew Fassett, Billerica, Mass.

[73] Assignee: Raytheon Company, Lexington, Mass.

[22] Filed: Mar. 7, 1972

[21] Appl. No.: 232,404

[52] U.S. Cl. ..... 343/854; 343/16 M; 333/84 L

[51] Int. Cl.[2] ..... H01Q 1/28; H01Q 3/26

[58] Field of Search ..... 343/705, 708, 765, 778, 343/854, 16 M; 333/84 L

[56] References Cited

UNITED STATES PATENTS 3,673,606 6/1972 Maune ..... 343/854

*Primary Examiner*—Eli Lieberman

*Attorney, Agent, or Firm*—Philip J. McFarland; Joseph D. Pannone

[57] ABSTRACT

An improved directional antenna for use in an airborne vehicle is shown. The contemplated antenna includes a planar phased array of antenna elements mechanically rotatable about an axis of rotation, the plane of such array making an acute angle with such axis. The beam from such array may be electronically scanned, within wide limits, regardless of the orientation of the phased array. Also shown is an improved constrained centerfeed for the antenna elements in each row thereof in such array, the disclosed feed incorporating a double ladder arrangement, including wideband couplers, to permit the extensive use of stripline and at the same time to allow practically independent adjustment of azimuth and elevation difference patterns when the phased array is used as an element in a monopulse system.

9 Claims, 9 Drawing Figures

AIRBORNE MULTI-MODE RADIATING AND RECEIVING SYSTEM

BACKGROUND OF THE INVENTION

This invention pertains generally to airborne radar systems and particularly to radar systems of such type which are adapted to perform more than one function.

It is known in the art that so-called multi-mode radar systems (meaning systems that may perform different functions, either simultaneously or in a rapid sequence) incorporate directional antennas which may be required to scan in many different ways. If such a system is to be airborne, as by a high performance aircraft, the problem of providing a satisfactory scanning technique is particularly difficult to solve. In such an application, the location of a directional antenna is, for aerodynamic reasons, restricted to the interior of a streamlined radome making up the nose section of the aircraft. With a scanning antenna so located, the limit of the scanning field of a mechanically scanned beam is in the order of 60° from the longitudinal centerline of the aircraft. A scanning field of such limited size is too small for many modes of operation. Further, if rapid scanning in azimuth and elevation is required, it is necessary to provide a relatively large, heavy and powerful mechanical scanning mechanism. Such a scanning mechanism, obviously, is detrimental to the optimum capability of the radar and the aircraft.

If a mechanical scanning mechanism is replaced by any known electronic scanner (to permit rapid scanning), other types of problems are encountered. For example, because the width of the beam from a phased array antenna increases with scan angle, antenna gain decreases. Thus, at a scan angle of say 60°, the beamwidth doubles as compared to the beamwidth at broadside. Nevertheless, because a beam from a phased array antenna may be scanned so much more quickly than the beam from a mechanically scanned directional antenna, some kind of phased array antenna is required for multi-mode airborne radar.

If a phased array antenna is to be mounted in a streamlined radome in a high performance aircraft, several problems unique to such an installation are encountered. First, it is necessary, to avoid the occurrence of grating lobes within the scanning field, to place the individual antenna elements of a phased array as closely together as possible. Further, the type of feed used to illuminate a phased array is important, it being necessary to use some kind of constrained back feed in order to avoid antenna blockage. Any known "space fed" system must be folded to fit inside the radome, thereby creating subsequent alignment and efficiency problems; and any known "radial feed" prevents optimum disposition of the antenna elements in the array.

The difficulties mentioned hereinbefore are multiplied when operational requirements dictate that the radar in an aircraft combine high power and angular discrimination capabilities. To meet power requirements, a maximum amount of radio frequency energy, (concomitant with a satisfactory beam shape) must be radiated from each one of the antenna elements. To permit such a maximum amount of radio frequency energy to be radiated, it is necessary, in the present state of the art, to cool the antenna elements and associated control circuitry. Such cooling must be as effective at high as at low altitudes, with the result that a positive way of cooling at any operational altitude be provided. To meet both requirements, the radar beam must be narrow and well formed, implying that there be a large number of antenna elements and that the power to each be controllable. To meet angular discrimination requirements for many applications it is highly desirable that the radar be a monopulse radar. Any known constrained feed for a monopulse radar entails the extensive use of waveguide transmission lines and conventional couplers. The resulting feed is intolerably heavy and critical to adjust. Such deficiencies, when the array is to be of any appreciable size, make it infeasible to use a conventional corporate feed.

SUMMARY OF THE INVENTION

Therefore, it is a primary object of this invention to provide improved scanning apparatus for a directional antenna in an airborne monopulse radar system, such apparatus being operative in a way that the scan angle, relative to an aircraft's longitudinal centerline, may be increased.

Another object of this invention is to provide an improved scanning apparatus for a directional antenna in an airborne monopulse radar system, such apparatus combining selected features of mechanical and electronic scanning mechanisms.

Still another object of this invention is to provide, in an airborne monopulse radar system having its antenna mounted in a radome integral with the nose section of an airborne vehicle, an improved directional antenna and scanning apparatus therefor.

A still further object of this invention is to provide an improved phased array antenna and constrained feed system therefor.

These and other objects of this invention are attained generally by providing, in an ogival radome making up the streamlined nose section of a high performance aircraft, an improved planar phased array antenna and feed therefor (the face of such array antenna being inclined with respect to the longitudinal centerline of the aircraft and the outline of such face being generally elliptical to correspond with a diagonal section through the radome), means for mounting the array antenna so that it is mechanically rotatable about the longitudinal centerline, or an axis inclined thereto, of such aircraft; and means for combining mechanical and electronic beam directing apparatus as required for any one of a number of desired modes of operation to scan a field in an optimum fashion. This invention also contemplates the use of a novel arrangement of the antenna elements and their associated elements, such as phase shifters, to permit a stripline ladder feed to be used for such elements and air cooling to be provided in a simple and efficient manner.

BRIEF DESCRIPTION OF THE DRAWINGS

For a more complete understanding of this invention, reference is now made to the following description of the accompanying drawings in which.

DESCRIPTION OF THE PREFERRED EMBODIMENTS

Figure 1:
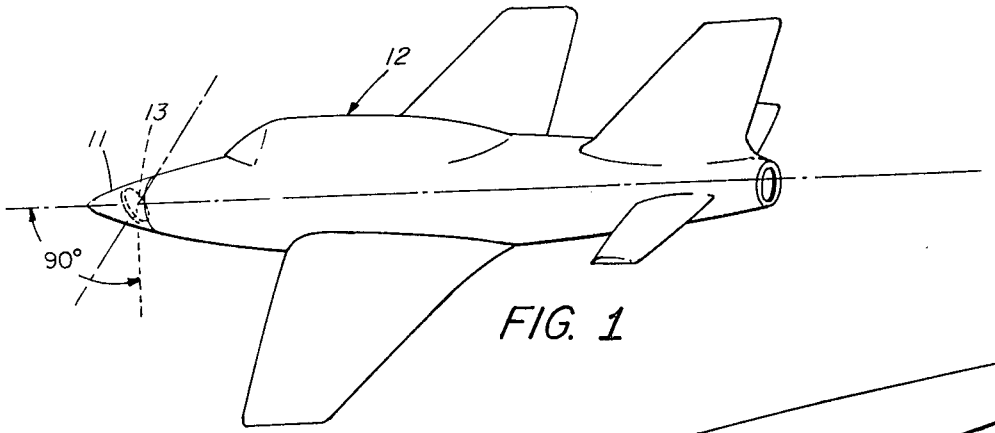
FIG. 1 is a sketch showing generally the contemplated location of the contemplated directional antenna in a high performance aircraft and exemplary limits of the scanning field of such antenna.

Referring now to FIG. 1 it may be seen that the contemplated directional antenna is mounted within a streamlined radome 11 which makes up the nose section of an aircraft 12. The directional antenna includes a phased array antenna 13 (and associated elements to be described) rotatably mounted on a bulkhead (not numbered) so that the axis of rotation of such array is tilted at an angle to the longitudinal axis of the aircraft 12. As may be seen more clearly in FIG. 2, the bulkhead may also be tipped with respect to the longitudinal centerline of the aircraft 12. That is, the phased array antenna 13 is mounted in such a manner that the direction of the beam therefrom may be rotated around the longitudinal axis of the aircraft 12 by mechanically rotating the array antenna itself. Independently, of course, the beam may be collimated and deflected by controlling the phase shift of the radio frequency energy to each antenna element in the array. By appropriately combining such mechanical and electronic beam steering techniques it will be seen that the scanning field is greater than the forward hemisphere centered on the aircraft. It follows, then, that the maximum coverage area of the contemplated antenna arrangement exceeds that of a conventional phased array antenna rigidly mounted within a streamlined radome, i.e. a phased array antenna with its face fixed in position substantially orthogonal to the longitudinal centerline of the aircraft. The maximum coverage area of such an array, as is known, is somewhat less, in all practical applications, than the forward hemisphere.

As noted hereinbefore, the face of the phased array antenna 13 has a substantially elliptical outline corresponding to a diagonal section of the radome 11. The area of such an elliptical outline is greater than the area of a circle with a diameter substantially equal to the minor axis of the elliptical outline. It follows, then, that the actual aperture of the phased array antenna 13 is larger than the actual aperture of a comparable conventional phased array antenna mounted at the same location within the radome 11. That is, the broadside beam of the contemplated phased array antenna has a greater directivity than the broadside beam of a comparable conventional phased array antenna. The direction of the broadside beam of the contemplated phased array antenna is oriented at an angle "A" (here 45°) with respect to the longitudinal centerline of the aircraft 12, whereas the broadside beam of a conventional phased array antenna is "dead ahead". When the beam from the contemplated phased array antenna is deflected by an angle "A" (so as here to point either "dead ahead" or to the beam of the aircraft 12), the projected area of the aperture of the contemplated phased array antenna is the same as the actual area of a conventional phased array antenna. It follows then that the directivity of the beam of the contemplated phased array antenna (when deflected to point either "dead ahead" or to the beam of the aircraft 12) is the same as the directivity of the broadside beam of a conventional phased array antenna. Obviously, then, the beam of the contemplated phased array antenna (when directed abeam of the aircraft 12) has far greater directivity than a similarly directed beam of a conventional phased array antenna. As a matter of fact, when the beam from the contemplated phased array antenna is deflected abaft of the beam of aircraft 12, the decrease in directivity then suffered is the same as the decrease in directivity suffered by the beam of a conventional phased array antenna in being deflected a like amount from dead ahead. To put it another way, the contemplated phased array antenna is "end fired" when its beam is deflected 135° from dead ahead as contrasted with the conventional phased array antenna which is "end fired" when its beam is deflected 90° from dead ahead.

Figure 2:
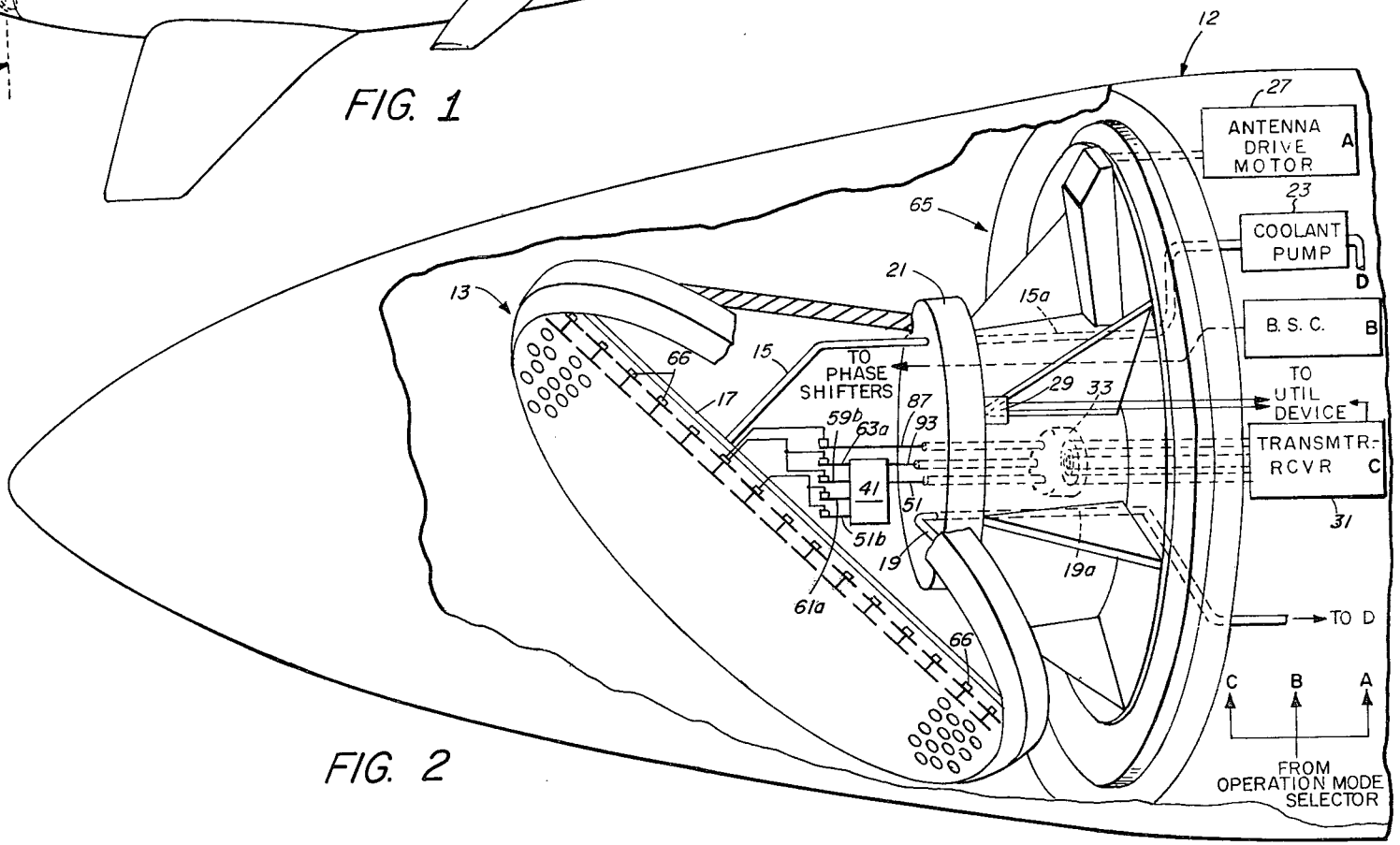
FIG. 2 is an outline drawing, partially broken away and somewhat simplified, of the nose section of the aircraft of FIG. 1, to illustrate a way in which a directional antenna and other necessary elements be rotatably mounted in the radome indicated in FIG. 1 to allow a scanning field to be covered most efficiently.

Referring now to FIG. 2 it may be seen that the phased array antenna 13 includes a hollow elliptical ring (not numbered) in which a number of I-beams (one of which is partially shown in FIG. 8) is mounted adjacent to one another. Each I-beam, as will be shown more clearly hereinafter, supports two rows of antenna elements and associated phase shifters and a stripline feed. The front and back of the phased array antenna 13 are covered by sheets (not shown) of material to make a substantially airtight enclosure in which the I-beams, antenna elements and associated phase shifters and stripline feeds are mounted. The antenna elements and the associated phase shifters and stripline feeds are shown in detail hereinafter. Suffice it to say here that the stripline feed is operative to feed, from the center of each row, the antenna elements in each half of each row. The sheet covering the rear of the phased array antenna 13 has openings formed therethrough to permit a pipe 15 to pass through to a manifold 17. Such manifold is disposed at right angles to the I-beams and extends to the rim portion of the antenna. Openings (not shown in the manifold 17) permit a coolant, as air under a positive pressure, to pass from the pipe 15 through the manifold 17 and along the channels formed by the I-beams to the rim portion. A pipe 19 is connected from the rim portion to a platform 21. The pipe 15 and the pipe 19 are passed through the platform 21 to annular plenum chambers (not shown) under the platform. Each plenum chamber in turn is connected to pipes **15*a*, 19*a* to a coolant pump 23. When the pump is operated the air may pass through pipe 15*a*, the corresponding plenum chamber pipe 15 and the manifold 17 to the center portion of each I-beam. Such air then passes outwardly of the antenna elements to the rim portion of the phased array antenna to cool such elements. The air arriving in the rim portion of the phased array antenna 13 is drawn therefrom through the pipe 19, the corresponding plenum chamber and the pipe 19***a* to the inlet of the coolant pipe 23. Obviously, if desired, the air drawn from the rim portion of the phased array antenna 13 may be cooled in any conventional way before it is drawn to the inlet of the coolant pipe 23.

The platform 21 is rotatably mounted in any convenient fashion on a pedestal 25, which in turn is secured in any conventional fashion to a bulkhead (not numbered) of the aircraft 12. In passing it should be noted that the bulkhead need not be, as illustrated in FIG. 2, orthogonal to the longitudinal axis of the aircraft but may, for some applications, be tilted with respect thereto. In any event, the platform 21 may be rotated about its rotational axis by an antenna drive motor 27 operating through a conventional gearing arrangement (not numbered). It is evident that the antenna drive motor 27 may be operated so as to rotate the platform 21, and the elements mounted thereon, continuously about its rotational axis or may be de-energized so that the phased array antenna 13 remains stationary with respect to such rotational axis. The rotational position of the phased array antenna 13 is sensed here by a resolver 29 which produces, in a conventional manner, signals indicative of the instantaneous position of the phased array antenna 13.

A constrained feed is provided for radio frequency energy between the phased array antenna 13 and a radar transmitter/receiver 31 mounted in the body of the aircraft 12. Thus, for reasons to become clear hereinafter, a three channel rotary joint, 33, together with appropriate waveguide (not here numbered) is provided to permit radio frequency energy from the radar transmitter/receiver 31 to be passed through the platform 21. Each one of the waveguides which rotates with the platform 21 is here represented schematically as waveguides 51, 87, 93 (to correspond with the notation of FIG. 3). Waveguides 51 and 93 are connected, through a ladder network 41 (shown schematically in detail in FIG. 3) ultimately to four waveguides, 51*b*, 61*a*, 59*b* and 63*a*. The latter lines in turn are coupled to row distributors 66, again as shown schematically in FIG. 3. Line 87 is coupled directly to a hybrid junction 85 (FIG. 3).

Figure 3:
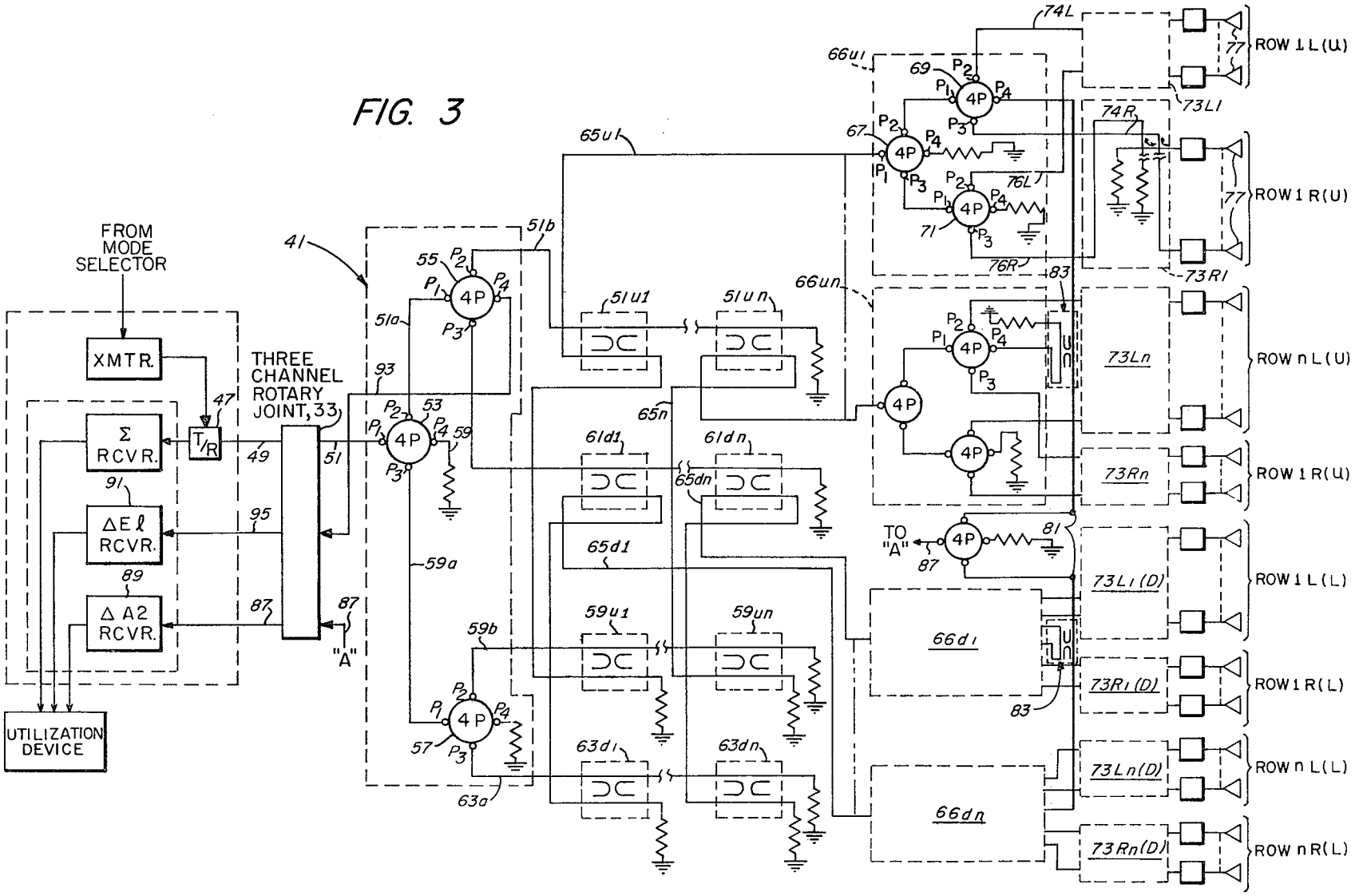
FIG. 3 is a schematic diagram illustrating the manner in which the antenna array shown in FIG. 2 may be centerfed and separately optimized sum and difference signals may be derived for monopulse operation.

Referring now to FIG. 3, it may be seen that pulses of radio frequency energy from a transmitter 45 in the transmitter/receiver 31 (FIG. 2) are passed through a conventional transmit/receive switch (TR 47), waveguide 49, a three channel rotary joint 33 and waveguide 51 to the ladder network 41 on the platform 15. This network here is schematically shown to include three conventional four port hybrid junctions (4P53, 4P55 and 4P57) connected as shown.

As is known, nondirectional junctions or branch couplers equivalent to a four port hybrid junction may be formed by placing two uniform waveguides side by side, with an aperture between the two providing the desired coupling. In such an arrangement, the waveguide carrying radio frequency energy to the aperture may arbitrarily be designated "port 1" (P1) and the same waveguide after the aperture may be designated "port 2" (P2); the second waveguide after the aperture "port 3" (P3) and the second waveguide before the aperture "port 4" (P4) to correspond with normal nomenclature for four port hybrid junctions. As in all such hybrid junctions, P1 and P4 are isolated one from the other; radio frequency energy, fed into P1 is divided between P2 and P3, the ratio of the radio frequency energy in P2 and P3 being dependent on the coupling effected by the aperture; an amount of radio frequency energy proportional to the sum of radio frequency energy fed into P2 and P3 appears at P1; and an amount of radio frequency energy proportional to the difference between radio frequency energy fed into P2 and P3 appears at P4. The four port hybrid junction 51 is preferably such a branch coupler as just described, waveguide 51a being an extension of waveguide 50 and waveguides 59, 59a being the branch line. Waveguide 59 is terminated, in any convenient manner, in its characteristic impedance (not numbered) to eliminate the effect of unwanted reflections. It follows, then, that radio frequency energy from waveguide 51 is divided between waveguides 51*a* and 59*a*. It should be noted here that, although a conventional "Magic Tee" could be used as the 4 port hybrid coupler 53, it is preferable to use a branch coupler so that the relative amounts of radio frequency energy in waveguides 53*a*, 59*a* may be easily controlled. As will become clear hereinafter, an unequal division of the ratio frequency energy between waveguides 51*a* and 59*a* is desirable to form a given amplitude distribution across the aperture of the phased array antenna 13 (FIG. 2).

The radio frequency energy in each one of the waveguides 51*a*, 59*a* is again divided in branch couplers, here 4P55 and 4P57, with the result that radio frequency energy appears in waveguides 51*b*, 61*a*, 59*b*, 63*a*. Each one of the latter is terminated, as shown, in its characteristic impedance (not numbered). It now is clear that, during transmission, the radio frequency energy out of the transmitter 45 is divided between waveguides 51*b*, 61*a*, 59*b*, 63*a*, the exact amount of such energy in each such line being determined by the coupling of the branch couplers 53, 55, 57. Obviously, if it is desired to have an equal amount of radio frequency energy divided between waveguides 51*b*, 51*a* and a different, but equal, amount divided between waveguides 59*b*, 63*b*, branch couplers 55, 57 may be replaced by conventional "Magic Tees."

A number of contradirectional couplers, as couplers 51(*ui*) . . . 51(*un*), 61(*di*) . . . 61(*dn*), 59(*ui*) . . . 59(*un*), 63(*di*) . . . 63(*dn*) is disposed as shown along the length of waveguides 51*b*, 61*a*, 59*b*, 63*a*. It is here noted that these couplers are preferably of the type described hereinafter in connection with FIG. 4. Suffice it to say here that the couplers are effective to couple, as indicated by the curved lines in each, a portion of the radio frequency energy to and from the waveguides 51*b*, 61*a*, 59*b*, 63*a* and transmission lines 65(*ui*) . . . 65(*un*), 65(*di*) . . . 65(*dn*). Here *u* means "upper half" of the phased array antenna being fed and *d* means the "lower half" of such antenna and *n* means the number of rows in each half. The recombined energy is fed to a different one of the "row" distributors 66(*ui*) . . . 66(*un*), 66(*di*) . . . 66(*dn*). The schematic of two of the row distributors are shown, it being understood that the others are similar. Thus, the illustrated row distributor 66(*ui*) fed by transmission line 65(*ui*) includes four port hybrid junctions 4P67, 4P69, 4P71 connected as shown. Each such junction is preferably a stripline junction of the type shown in FIG. 5. Suffice it to say here that these junctions operate in the same way as conventional four port hybrid junctions. Corresponding ports (here the P2 ports) of 4P69 and 4P71 are connected to a line feed 73(L1) (which feed is shown in FIG. 6) and corresponding ports (here the P3 ports) of 4P69 and 4P71 are connected to the line feed 73(R1). "L" here means "left side of the array" and "R" means "right side of the array." As shown schematically, for line feed 73(R1), radio frequency energy from port 3 of 4P69 on transmission line 74R (which line is sometimes referred to hereinafter as center conductor 74R) is coupled to a number of transmission lines (as lines 74R1 . . . 74RN). Each one of such lines (except the last) is coupled to transmission line 74R by a stripline coupler (FIG. 6). A phase shifter 75, an antenna element 77 and a load 79 (FIG. 7) are connected as shown to each one of the last mentioned transmission lines. The last one of the last mentioned transmission lines is directly connected as shown to the transmission line 74R from P3 of 4P69. Radio frequency energy from port 3 of 4P71 is coupled to the antenna elements in a similar manner except that the transmission line 76R (sometimes referred to hereinafter as center conductor 76R) from P3 of 4P71 is here terminated in a load (not numbered).

It will be observed that the amount of radio frequency energy arriving at each antenna element 77 is dependent upon the adjustment of the couplers and the four port hybrid junctions in the path between each antenna element and the transmitter 45. It will also be observed that: (a) for each antenna element there are two elements, i.e. the couplers in each line feed 73, which are individually adjustable (within relatively wide limits) to vary the amount of radio frequency energy to each element in the right and left side of each row of antenna elements; (b) there are elements, i.e. the four port junctions 4P67, 4P69, 4P71, which divide, in any ratio within wide limits, radio frequency power between the right and left side of each row of antenna elements; (c) there are elements, i.e. contradirectional couplers 51, 61, 59, 63, which divide, within wide limits, radio frequency energy between rows of antenna elements; and (d) there are elements, i.e. 4P53, 4P55, 4P57, which divide radio frequency energy between columns of antenna elements. It will be apparent now that, even though calculation is complicated by the fact that there are 10 interacting coupling elements between each antenna element and the transmitter 45, the proper coupling coefficient for each one of such elements may be made using known techniques to meet a given amplitude distribution across the aperture of the phased array antenna. In this connection it should also be observed that the number of antenna elements 77 in each row may be, and here is, changed. It follows, then, that, although the aperture of the phased array antenna 13 (FIGS. 1 and 2) is elliptical, the illustrated feed may be used if other aperture shapes are required. Further, it is noted that the number of antenna elements 77 coupled to transmission line 74R or 74L may not, and here is not, equal to the number of antenna elements 77 coupled to transmission line 76R or 76L.

The phase shifters 75, which may be either conventional ferrite or semiconductor phase shifters, are, of course, individually controllable by signals over lines (not shown in FIG. 3) from the beam steering computer (FIG. 2).

When echo signals are received, the illustrated feed system operates, by reciprocity, to effectively divide the aperture of the array into a "left" and a "right" portion (to permit derivation of an azimuth difference signal, $\Delta A_3$), an "up" and a "down" portion (to permit derivation of an elevation difference signal, $\Delta E1$) along with a sum signal, $\Sigma$. That is, the illustrated feed system operates in a monopulse mode.

It will be observed that echo signals from the antenna elements in each half of the first row are passed over transmission lines 74L and 74R to ports 2 and 3 of 4P69. The difference between such echo signals then appears at port 4 of 4P69 and their sum appears at port 1. The difference signals out of port 4 are here connected directly to one end of a waveguide 81. The *n*th row distributor in the lower half of the array is connected to the second end of the waveguide 81. The difference signals from port 4 of each one of the corresponding four port hybrid junctions in each other row distributor 67 are coupled to the waveguide 61 as shown. That is, difference signals from all other row distributors 67 are coupled through contradirectional couplers 83 (FIG. 4) to waveguide 81. The resultant signals in waveguide 81 are, therefore, proportional to the net difference signals from the left and right halves of the phased array antenna (FIGS. 1 and 2). To put it another way, the resultant signals in the waveguide 81 are indicative of desired $\Delta A_Z$ signals. Such resultant signals are coupled through a four port hybrid junction 85 to a waveguide 87 and thence, through the three channel rotary joint 33 and waveguide 87, to $\Delta A_Z$ receiver 89.

The sum signals out of 4P69 and 4P71 are summed again in 4P67. The resulting signals are passed, as shown, via transmission line 65 *ul*, contradirectional coupler 51 *ul* and waveguides 51*b*, 59*b* to port 2 of 4P55 and 4P57. Similarly, the resulting signals out of the remaining row distributors 67 in the upper half of the array are passed to the same ports. The resulting signals out of the row distributors in the lower half of the array are, however, passed to port 3 of 4P55 and 4P57. The difference signals out of 4P55 and 4P57 are each proportional, then, to the desired $\Delta E1$ signals. Either or both (here the difference signals at port 4 of 4P55) may be passed to a $\Delta E1$ receiver 91 through a waveguide 93, the three channel rotary joint 33 and a waveguide 95.

The sum signals out of 4P55 and 4P57 are passed to ports 2 and 3 of 4P53. The sum signals out of the latter, then, are composite signals representative of the weighted sum of the radio frequency energy received by all of the antenna elements 77, i.e. the desired $\Sigma$ signals. Such composite signals are passed, via the waveguide 51, the three channel rotary joint 33, the waveguide 49 and the T/R switch 47, to a $\Sigma$ receiver 97.

It will now be apparent that the aperture distribution of the "$\Delta A_Z$" path and the aperture distribution of the $\Delta E1$ path may be, and in fact here is, adjusted to be different. That is, the coupling coefficients of the couplers in the "$\Delta A_Z$" paths may be adjusted (keeping the coupling coefficients of the couplers for optimum transmitting and "$\Sigma$" path) and then coupling coefficients of the couplers in the $\Delta E1$ paths (but not in the $\Delta A_Z$ paths) may be adjusted to attain optimum sum and difference patterns.

Figure 4:
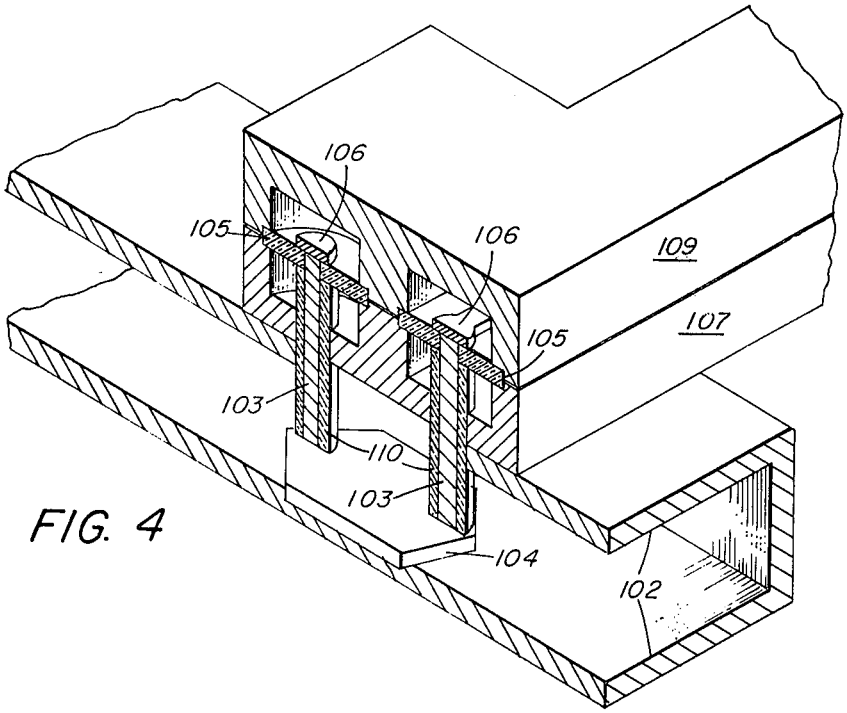
FIG. 4 is a sketch illustrating the construction of a typical waveguide coupler used in the radio frequency circuit shown in FIG. 3, such coupler being adapted to use over a relatively wide bandwidth of frequencies.

Referring now to FIG. 4 it may be seen that the contradirectional couplers (shown in FIG. 3 as couplers to the waveguides 51*b*, 61*a*, 59*b*, 63*a* and 81) are unitary structures which mount on an opening formed in the side walls 102 of the waveguides. Each coupler includes a pair of coupling posts 103 at the longitudinal axis of the waveguide, the free end of each such post being secured, as by soldering, to a matching plate 104. The coupling posts 103 are held in position by attaching them to a pair of dielectric sheets 105 on which electrically conductive strips 106 are formed. The dielectric strips 105 in turn are held by opposing metallic channels 107, 109. The coupling posts 103 are electrically insulated from the channel 107 by dielectric sheaths 110. It will be recognized that, taken together, the metallic channel members 107, 109, the dielectric sheets 105 and, the conductive strips 106 make up a microwave strip circuit with an air dielectric between the center conductor and the ground planes. It is evident that the air dielectric in such a stripline may be replaced by a solid dielectric. The shape of matching plate 101 may be changed to adjust the matching between the disclosed coupler and the waveguide with which it is to be used. The degree of coupling may be changed by changing the length of the coupling posts 103.

In operation, assuming radio frequency energy to be propagated in a waveguide from left to right in the $TE_{10}$ mode, a portion of such energy is coupled by the left hand coupling post and passed through its associated strip 106. This establishes current flow from strip 106*a* through coupling ports 103*a*, matching plate 104 and up through coupling post 103 to strip 106. In other words, the current of energy in the waveguide flowing from left to right may not be coupled out through strip 106*a*. The radio frequency energy not coupled out of the waveguide passes to the right in the Figure as shown.

Figure 5:
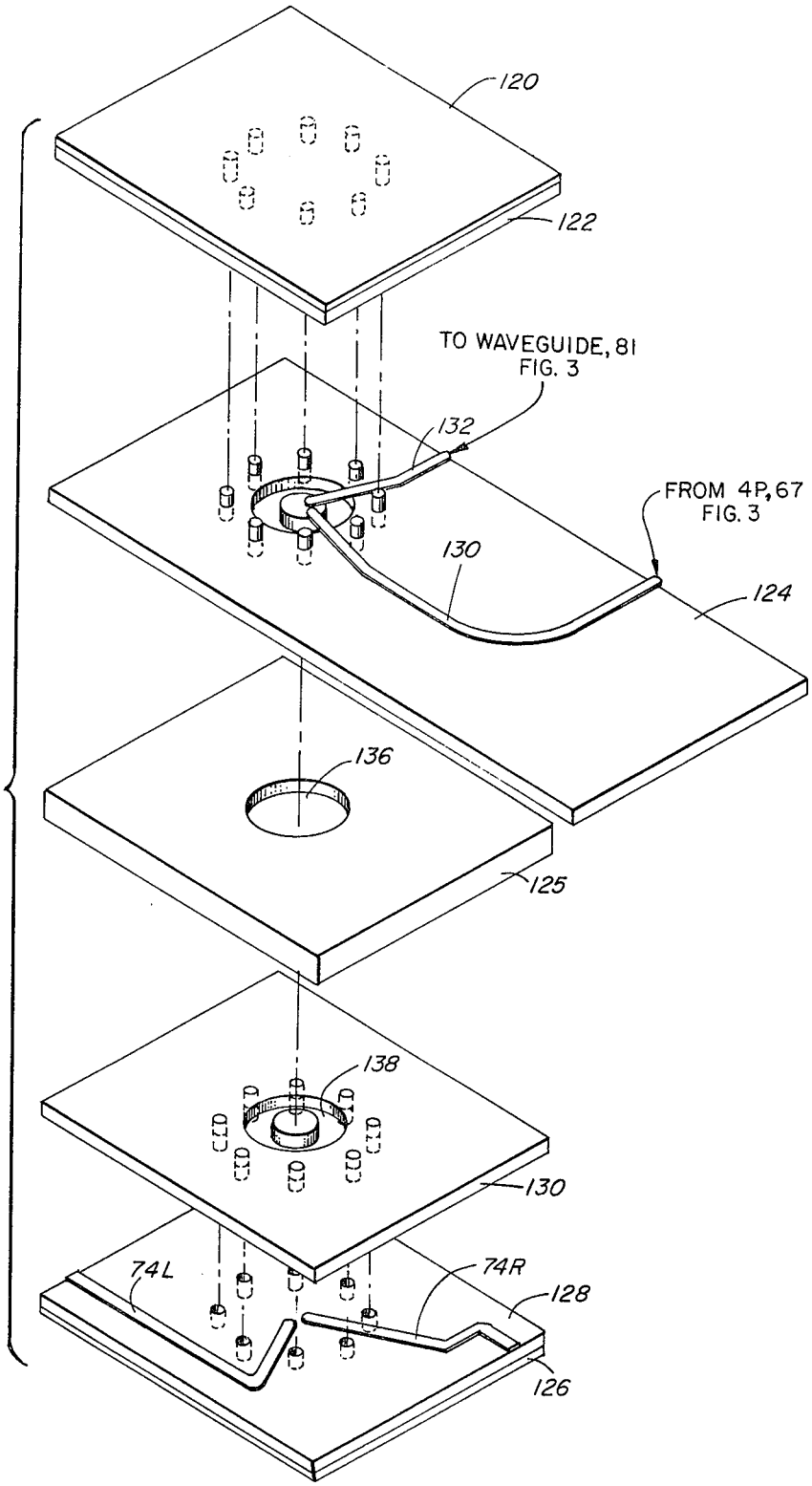
FIG. 5 is an exploded view of an improved "four port" stripline hybrid junction particularly useful in the circuitry shown in FIG. 3 and generally for any stripline circuit.
Figure 6:
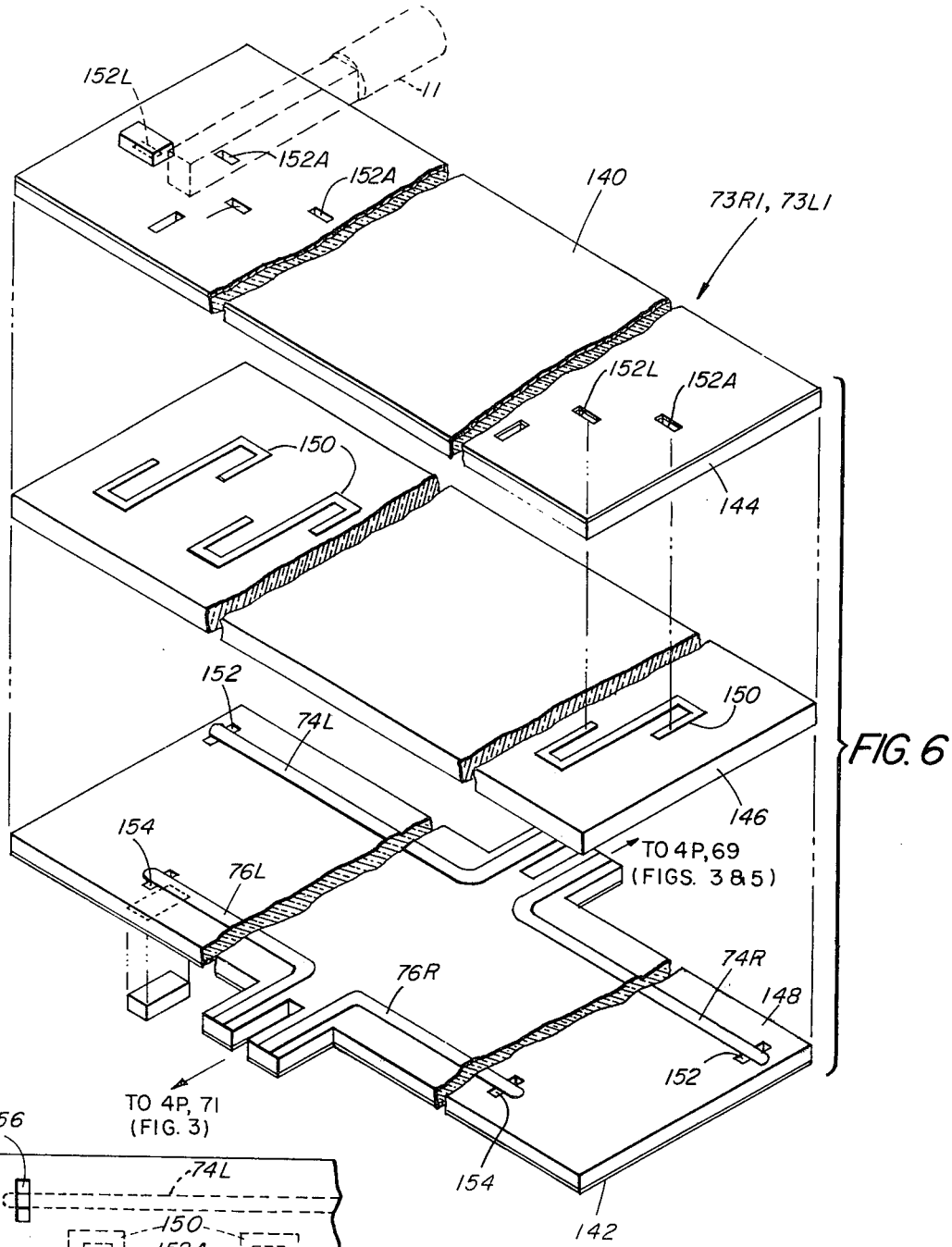
FIG. 6 is an exploded view of the stripline circuitry contemplated to centerfeed a row of antenna elements shown in FIG. 3.

Referring now to FIG. 5, a preferred embodiment of a stripline-to-stripline four port hybrid junction (as 4P67, 4P69, 4P71 of FIG. 3) is shown. Specifically, 4P69 is illustrated. The contemplated junction, in essence, is made up of a first stripline (ground conductor 120, dielectric sheets 122, 124 and one side of a metallic plate 125) and a second stripline (ground conductor 126, dielectric sheets 128, 130 and the second side of a metallic plate 125), each such stripline having center conductors to be described between the dielectric sheets. The center conductors 130, 132 in the first stripline (which center conductors are here shown, for convenience, on dielectric sheet 124 but which are more easily formed on dielectric sheet 122) are orthogonal to each other, overlying an annular slot 134 formed in the dielectric energy is introduced on either center conductor 130, 132, the result is to set up a $TE_{11}$ field in the annular slot 134. Thus, if, for example, radio frequency energy is introduced on center conductor 130 from port 2 of 4P67, center conductor 132 is positioned so that none of such energy is coupled thereto. The $TE_{11}$ mode in the annular slot 134 is supported by a circular opening 136 formed through the metallic plate 125, it being recognized that circular opening 136 constitutes a length of circular waveguide. (In passing it will be noted that circular opening 136 may be filled with a dielectric other than air). Such mode is, therefore, coupled to an annular opening 138 in the dielectric sheet 130 to couple with center conductors 74R, 74L on the dielectric sheet 128. The latter center conductors are here disposed so as to make an angle of 45° on either side of the center conductor 130. It may be seen, therefore, that when radio frequency energy is introduced on center conductor 130, equal amounts of such energy will be coupled to center conductors 74R, 74L. In other words, when center conductor 130 is energized (as it is on transmission) the left and right sides of row 1 of the upper portion of the array will receive equal amounts of radio frequency energy from 4P69. On the other hand, during reception, equal amounts of radio frequency energy are passed (in the form of echo signals) to 4P69 over center conductors 74R, 74L. The echo signals from a target on the centerline of the radar beam pass simultaneously over such center conductors. The resultant $TE_{11}$ field set up by such echo signals corresponds to the vector sum of the $TE_{11}$ field from the center conductors 74R, 74L. Such resultant field is aligned with center conductor 130 and orthogonal to center conductor 132. Therefore, signals representative of the sum ($\Sigma$ signals) appear on center conductor 130, and signals (here zero) representative of the ($\Delta A_3$) signals appear on the center conductor 132. When echo signals are received from a target not on the centerline of the radar beam, there is a difference in phase between the echo signals on the center conductors 74R, 74L. The resultant $TE_{11}$ field set up by such "out of phase" echo signals then is rotated (by an amount related to such difference in phase) so that it is no longer aligned with the center conductor 130 or exactly orthogonal to the center conductor 132. Consequently, the $\Sigma$ signals and the $\Delta$ signals change. The change in the $\Sigma$ signals is, as compared to the change in the $\Delta$ signals, relatively small as in any monopulse arrangement.

Figure 6A:
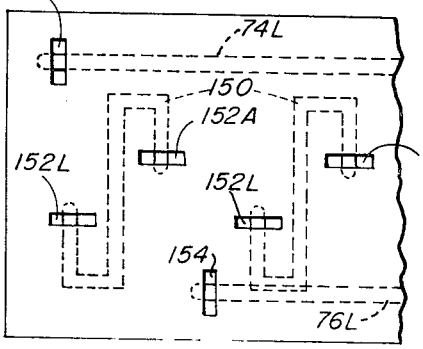
FIG. 6A is a detail view of placement of coupling element.

Referring now to FIGS. 6 and 6A it may be seen that the contemplated line feed (as line feeds 73L1, 73R1, FIG. 3) comprises stripline circuitry wherein the coupling coefficient between the line feed and a number of antenna elements may be adjusted. Thus, the line feed for a single row of antenna elements comprises conventional metallic ground conductors 140, 142 between which first, second and third dielectric sheets 144, 146, 148 are disposed. The end portions of center conductors 74R, 76R, 74L and 76L (here shown for convenience on the third dielectric sheet 148 but actually printed on the second dielectric sheet 146 in normal practice) are parallel to each other as shown. A number of coupler members 150 (one for each antenna element 77) are printed on the second side of the second dielectric sheet 146. Coupling openings 152L, 152A, 154, 156 are formed, respectively, through the first dielectric sheet 144 and its adjacent ground conductor 140 and the third dielectric sheet 148 and its associated ground conductor 140. The position of the coupling openings relative to the center conductors 74L, 74R, 76L, 76R and to each one of the coupler members 150 is shown in FIG. 6A. A matched load (FIG. 7) is secured to the ground conductors 140 overlying the coupling openings 152L, 154, 156. An antenna element (FIG. 8) is secured to one of the ground conductors 140 overlying each coupling opening 152A.

As shown more clearly in FIG. 6A, each coupling member 150 is disposed so as to overlie center conductors 76L, 76R to a greater degree than center conductors 74L, 74R. It follows, then, that the coupling coefficient between center conductors 76L, 76R and each associated coupling element 150 is greater than the coupling coefficient between each such element and center conductors 74L, 74R. Therefore, the relative amounts of radio frequency energy coupled between each coupling element 150 and center conductors 74L, 74R, 76L, 76R differ. Thus, for example, assuming equal amounts of radio frequency energy initially on center conductors 74L, 74R, 76L, 76R, fewer "couplings" will be required to transfer the radio frequency power from center conductor 76R than from center conductor 74R (or from center conductor 76L than from center conductor 74L). It follows then that the number of coupling elements 150 coacting with center conductors 76L, 76R may be less than the number of coupling elements coacting with center conductors 74L, 74R. In other words, the outer antenna elements in each row (FIG. 3) may be coupled only through center conductors 74L, 74R. Such truncation of the feed to the outer antenna elements makes it easier to adjust the amplitude distribution across the aperture without sacrificing the advantages of the "double" feed.

Figure 7:
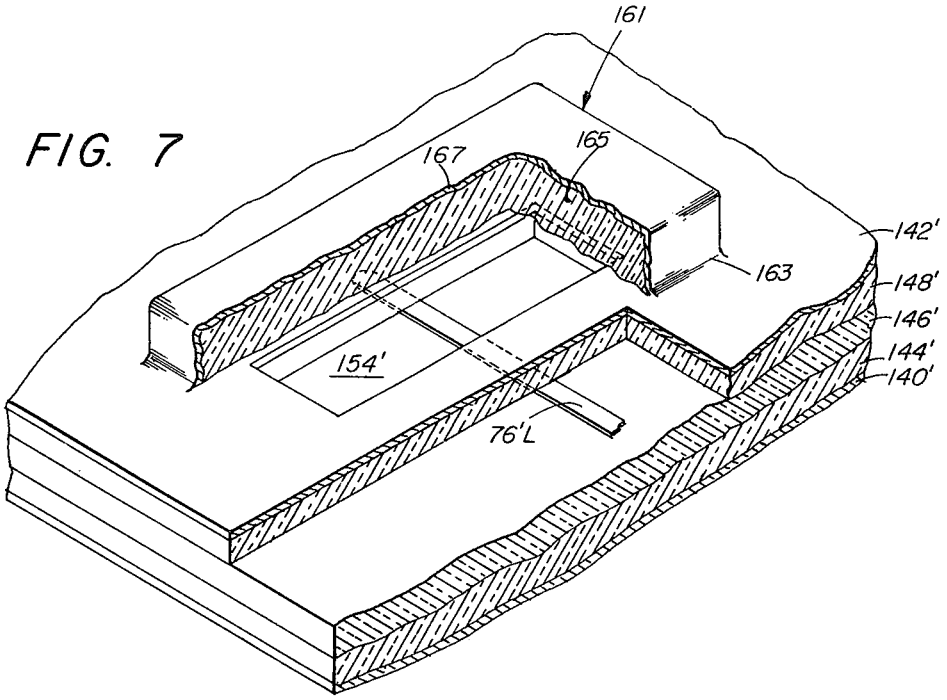
FIG. 7 is a partially cut away view of a radio frequency load for use with a stripline circuit.

Referring now to FIG. 7, it may be seen that a preferred type of load for the stripline line feed (FIGS. 3 and 6) consists simply of a block 161 of metallized load material affixed, as by an epoxy cement 163, to the ground conductor 142' and overlying the coupling opening 154'. The block 161 has a body 165 fabricated from a lossy material, as an iron-carbonyl loaded epoxy, covered by a metallic coating 167. Other lossy materials may be used, it being necessary here only that the block 161 constitute a lossy cavity. Radio frequency energy coupled into such a cavity is dissipated therein. The block 161 shown in FIG. 7 is symmetrically mounted over the coupling opening 154'. If it is desired to increase dissipation, the block 161 may be offset from the coupling opening 154' and used with other blocks and coupling openings (not shown).

Figure 8:
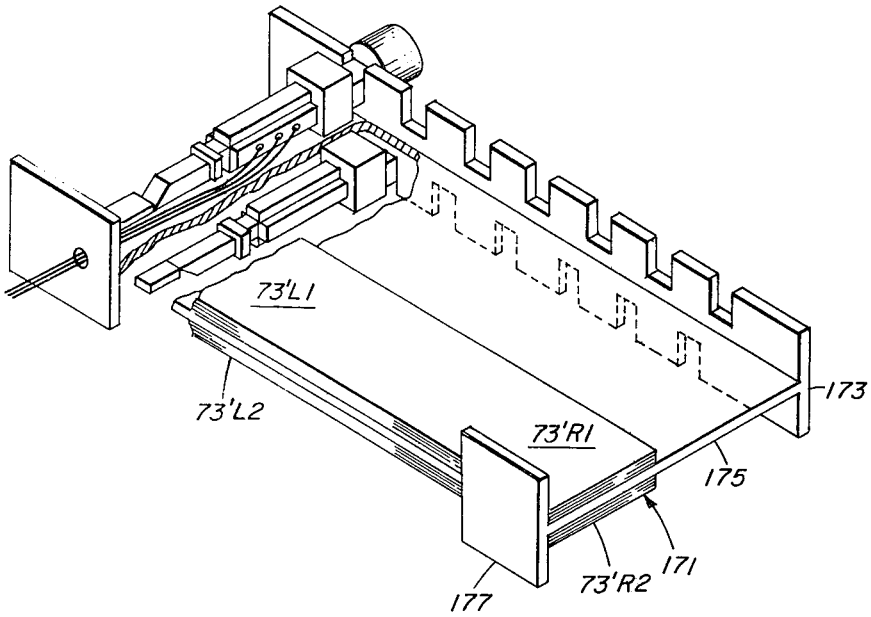
FIG. 8 is a partial view of the contemplated arrangement of each two adjacent rows of antenna elements of the array shown in FIG. 2, such view being simplified to show most clearly how such elements are mounted and arranged to be fed and cooled.

Referring now to FIG. 8, the details may be seen of a typical way in which antenna elements, associated phase shifters and stripline feeds for two rows in the array are mounted together. Thus, the Figure shows an I-beam 171 supporting the just mentioned elements, the web of such beam separating the rows. One flange 173 of the I-beam 171 is serrated, as shown, so that the centerlines of any two adjacent antenna elements in one row and the intermediate antenna element in the other row lie on the apices of an equilateral triangle. The actual spacing between such centerlines is slightly greater than one-half a wavelength of the radio frequency energy being transmitted and received. The line feeds (as $73'L_1$, $73'R_1$, $73'R_2$ are affixed, as by cementing, to the web 175 of the I-beam 171 adjacent to its second flange 177. The rear end of each one of the antenna element assemblies is affixed, as by cementing, to its associated line feed so that it is in register with its associated coupling opening in the line feed (see FIG. 6). To complete the assembly, the control lines 29 (FIG. 2) for the phase shifters in each antenna element assembly, are connected through an opening in the second flange 177 and the manifold 17 (FIG. 2) is connected through a central opening in such flange.

It will be noted that, as the phased array antenna 13 (FIG. 2) is rotated around its axis of rotation, the orientation of each antenna element changes with respect to the local vertical through the aircraft. Therefore, if linearly polarized, radio frequency energy is transmitted and the direction in which such energy is polarized will be dependent upon the angular position of the phased array antenna. That is, absent any control, the polarization of linearly polarized radio frequency energy will vary sinusoidally from vertical to horizontal as the array is rotated. In applications in which such a change is detrimental to proper operation, the polarization may be held to remain constant (as far as transmitted radio frequency energy is concerned) by programming a conventional polarization rotator (not shown) associated with each antenna element. If the antenna elements are such as to transmit circularly polarized radio frequency energy, there is no need for such an adjustment. It will further be noted that any effects of beam broadening when the beam from the phased array antenna 13 is deflected from broadside may be compensated. That is, any loss in antenna gain may be counterbalanced by deflecting the beam in such a manner that the beam is "stepped" from position to position with an equal "dwell" time at each position. When deflection is so accomplished, the amount of radio frequency energy reflected from any target at a given range is the same regardless of the deflection angle of the beam.

It may now be seen that combining mechanical and electronic scanning in the way just described permits the objects of this invention to be met. Thus, much of the double ladder portion (required to allow substantially independent optimization of the sum and difference channels in a monopulse radar) and the center feed portion for the antenna elements may be implemented with stripline circuitry rather than with a conventional waveguide or coaxial line arrangement. It follows then that the spacing between the individual elements in the array may be reduced to less than the minimum spacing possible with either conventional arrangement. Therefore, the beam from the disclosed phased array antenna may be deflected a greater amount without suffering from the effects of grating lobes. Such a greater possible deflection adds to the advantages mentioned hereinbefore for the contemplated phased array antenna. Still further, it may be seen that the various couplers shown and described are inherently "broadband" devices as compared with conventional couplers used in waveguide or coaxial line circuits. Such a characteristic, in turn, makes it far easier in practice to fabricate and assemble the disclosed phased array antenna.

It will be apparent to one of skill in the art that many changes may be made in the illustrated embodiment of this invention without departing from its inventive concepts. For example, although the invention has been described as a monopulse radar, it is evident that the use of a skewed phased array antenna which is rotatable would solve many problems connected with communications systems wherein at least one moving station is included. Further, it is evident that location of the disclosed phased array antenna need not be limited to the nose section of an aircraft, it being apparent that the skewed arrangement of the array may be adapted to use in pods or in the tail section. Still further, it is evident that, at the price of having additional weight on the platform, some of the elements shown mounted within the body of the aircraft may be shifted to the mount. In particular, the beam steering computer may be so moved without sacrificing too much if it is desired to reduce the number of slipring connections required in the phase shifter control circuitry. Or, if it is desired to eliminate the necessity of having a three channel RF rotary joint, the $\Delta A_Z$ and $\Delta E1$ receiving channels may be mounted on the platform. Or, still further, the air cooling arrangement shown may be replaced by a liquid cooling system because of the ease with which the array itself may be made to be liquid-tight. It is felt, therefore, that this invention should not be restricted to its disclosed embodiment but, rather, should be limited only by the spirit and scope of the appended claims.

What is claimed is:

1. In a phased array antenna for a monopulse radar, the antenna elements in such antenna being arranged in $n$ upper rows above a horizontal centerline and $n$ lowers rows below such centerline, in each one of such rows there being an equal number of antenna elements to the left and to the right of a vertical centerline, a constrained feed for each one of the antenna elements, such feed comprising:

a. a waveguide ladder network, responsive to radio frequency energy to be transmitted, for dividing such energy into an upper and a lower pair of waveguides, the radio frequency energy in the upper pair to be divided between the antenna elements in the $n$ upper rows and the radio frequency energy in the lower pair to be divided between the antenna elements in the $n$ lower rows;

b. $n$ waveguide-to-stripline couplers disposed along one waveguide in each pair thereof and $m$ waveguide-to-stripline couplers disposed along the other waveguide in each pair thereof, where $m$ is equal to, or less than, $n$, c. $2n$ stripline ladder networks, each one thereof responsive to the radio frequency energy in a different one of the $n$ upper and lower paths, for further dividing the radio frequency energy in each one of such paths into four serial feed striplines, a first pair of such striplines including a primary and a secondary feed directed toward the antenna elements to the left of the vertical centerline of a row of such elements and a second pair of such striplines including a primary and a secondary feed directed toward the antenna elements to the right of such centerline in the same row; and, d. stripline coupling means, responsive to the radio frequency energy in each one of the first and the second pair of serial feed striplines, for coupling radio frequency energy to, respectively, the antenna elements to the left and to the right of the vertical centerline in each row of antenna elements.

2. A constrained feed as in claim 1 wherein the waveguide ladder network includes:

a. a first hybrid junction, responsive to radio frequency energy to be transmitted, for dividing such energy between two waveguide sections, the relative amount of radio frequency energy in each one of such sections being adjustable; and b. a second and a third hybrid junction, each one thereof responsive to the radio frequency energy in a different one of the two waveguide sections for dividing such energy substantially equally between the upper and the lower pair of waveguides.

3. A constrained feed as in claim 2 wherein the coupling coefficient of each one of the $n$ waveguide-to-stripline couplers disposed along each waveguide in each pair thereof is adjusted to change the amount of radio frequency energy fed to each one of the $n$ upper and the $n$ lower paths.

4. A constrained feed as in claim 3 wherein each one of the $2n$ stripline ladder networks includes:

a. a third hybrid junction, responsive to the radio frequency energy in the associated one of the $n$ upper and $n$ lower paths, for dividing such energy into an internal primary and an internal secondary stripline, the relative amount of radio frequency energy in each one of such lines being adjustable; and b. a fourth and a fifth hybrid junction, responsive, respectively, to the radio frequency energy in the internal primary and the internal secondary stripline for dividing the radio frequency energy on each one of such striplines equally between two primary feeds and two secondary feeds.

5. A constrained feed as in claim 4 wherein the stripline coupling means includes:

a. "N" stripline couplers disposed along each one of the first and second pair of serial feed striplines, where "N" equals the number of antenna elements to the left and to the right of the vertical centerline in each row of antenna elements;

b. means for adjusting the coupling coefficient one of the "N" stripline couplers to its associated primary feed; and c. means for independently adjusting the coupling coefficient of the first "M" stripline couplers to its associated secondary feed, where "M" is less than "N".

6. A constrained feed system as in claim 5 wherein the spacing between successive adjacent ones of the stripline couplers is substantially one-half wavelength of the radio frequency energy to be radiated.

7. A constrained feed system as in claim 6 wherein the antenna elements, associated phase shifters, stripline couplers and at least the primary and secondary feeds for adjacent rows are mounted on opposite sides of the flange of an I-beam.

8. A constrained feed as in claim 7 having, additionally:

a. means for coupling the difference signals between echo signals on the secondary feeds to each row of antenna elements in the upper half of the array to a first length of waveguide;

b. means for coupling the difference signals between echo signals on the secondary feeds to each row of antenna elements in the lower half of the array to a second length of waveguide; and c. hybrid junction means, responsive to the difference signals in the first and the second length of waveguide, for forming composite $\Delta AZ$ signals corresponding to such difference signals.

9. A constrained feed as in claim 8 having, additionally, means, connected to the second hybrid junction in the waveguide ladder network, for forming composite $\Delta E1$ signals corresponding to the portions of the echo signals impressed on such junction.

* * * * *